US008761657B2

(12) United States Patent
Suzuki

(10) Patent No.: US 8,761,657 B2
(45) Date of Patent: Jun. 24, 2014

(54) IMAGE FORMING APPARATUS

(75) Inventor: Masato Suzuki, Susono (JP)

(73) Assignee: Canon Kabushiki Kaisha, Tokyo (JP)

( * ) Notice: Subject to any disclaimer, the term of this patent is extended or adjusted under 35 U.S.C. 154(b) by 404 days.

(21) Appl. No.: 12/758,283

(22) Filed: Apr. 12, 2010

(65) Prior Publication Data

US 2010/0278576 A1 Nov. 4, 2010

(30) Foreign Application Priority Data

Apr. 30, 2009 (JP) ..... 2009-111008

(51) Int. Cl.
*G03G 15/00* (2006.01)

(52) U.S. Cl.
USPC ..... 399/405; 399/406; 399/397

(58) Field of Classification Search
USPC ..... 399/405, 406, 397; 271/188, 207, 209, 271/272, 314
See application file for complete search history.

(56) References Cited

U.S. PATENT DOCUMENTS

| | | | | |
|---|---|---|---|---|
| 4,214,740 | A * | 7/1980 | Acquaviva | 271/3.2 |
| 5,653,439 | A * | 8/1997 | Rider et al. | 271/274 |
| 5,862,435 | A | 1/1999 | Suzumi et al. | |
| 5,991,555 | A | 11/1999 | Suzumi et al. | |
| 6,185,383 | B1 | 2/2001 | Kanari et al. | |
| 6,298,213 | B1 | 10/2001 | Miyamoto et al. | |
| 6,782,230 | B2 | 8/2004 | Yaomin et al. | |
| 6,816,701 | B2 * | 11/2004 | Saitoh | 399/406 |
| 6,965,742 | B2 | 11/2005 | Miyamoto et al. | |
| 6,998,589 | B2 | 2/2006 | Yano et al. | |
| 2007/0065201 | A1 * | 3/2007 | Fujiwara et al. | 399/405 |
| 2008/0237967 | A1 | 10/2008 | Suzuki et al. | |
| 2008/0310872 | A1 * | 12/2008 | Shishikura | 399/68 |
| 2008/0310900 | A1 * | 12/2008 | Lee | 399/406 |

FOREIGN PATENT DOCUMENTS

| | | |
|---|---|---|
| CN | 1722009 | 1/2006 |
| JP | 3-088672 A | 4/1991 |
| JP | 2001-302060 A | 10/2001 |
| JP | 2007-186337 A | 7/2007 |
| JP | 2007-297191 A | 11/2007 |

OTHER PUBLICATIONS

Notification of First Office Action, dated Feb. 28, 2012, issued by State Intellectual Property Office of the People's Republic of China, in Chinese Application No. 201010170935.6.

* cited by examiner

*Primary Examiner* — Matthew G Marini
*Assistant Examiner* — Allister Primo
(74) *Attorney, Agent, or Firm* — Fitzpatrick, Cella, Harper & Scinto

(57) ABSTRACT

Provided is an image forming apparatus including: a support portion configured to support first and second rollers to be able to increase/decrease a distance between an axis line of the first roller and an axis line of the second roller including a second roller body; an elastic member configured to urge at least one of the first and second rollers to relatively bring it close to the other; and a regulating portion configured to regulate, at a position at which part of the plurality of first roller bodies and part of the second roller body overlap each other in a direction orthogonal to the axial direction, movement of the at least one of the first and second rollers in a direction of increasing the distance between the axis line of the first roller and the axis line of the second roller.

11 Claims, 7 Drawing Sheets

IMAGE FORMING APPARATUS

BACKGROUND OF THE INVENTION

1. Field of the Invention

The present invention relates to an image forming apparatus for forming an image on a sheet.

2. Description of the Related Art

In an electrophotographic image forming apparatus such as a printer, a copying machine, or a facsimile, a toner image formed by an image forming unit is transferred onto a sheet, and the sheet with the transferred toner image is discharged to a sheet discharge tray through a sheet discharge roller after the toner image is fixed on the sheet in a fixing unit. There is known a method in which a conveying roller pair for conveying the sheet guides the sheet in between the conveying roller pair including two rollers arranged to be opposed to each other, and the sheet is conveyed while being sandwiched with a frictional force generated between the two rollers. In order to prevent deterioration of performance in stacking sheets on the sheet discharge tray due to a curl of the sheet and insufficient stiffness (i.e., insufficient rigidity) of the sheet, stiffening rollers are often adopted as a sheet discharge roller pair for discharging the sheet from an inside of the apparatus onto the sheet discharge tray. When the sheet passes, the stiffening rollers stiffen the sheet through forming the sheet into a multi-corrugated shape in a width direction orthogonal to a sheet conveying direction. Thus, stacking performance is improved.

However, there are various kinds of sheets, and hence stiffness (rigidity) inherent in the sheets is different in each sheet. As a conventional configuration, there is often adopted a configuration in which a center distance between the two rollers opposed in the sheet discharge roller pair is set to a certain distance. When the center distance is set to the certain distance, the sheet with low stiffness is short of a stiffening amount, and hence the sheet hangs down because the sheet does not have desired stiffness. Consequently, the hanging-down sheet may push forward sheets which have been already discharged onto the sheet discharge tray. In order to cope with this situation, a stiffening force is sometimes strengthened through increasing a corrugating amount of the sheet. However, according to the configuration in which the stiffening force is strengthened, in a case of a sheet with high stiffness such as a thick sheet of paper, stiffening is strongly performed by the sheet discharge roller pair. When the stiffening is performed, due to high stiffness of the sheet, the sheet may strongly come into contact with the sheet discharge roller pair. In this case, of the sheet, on a portion strongly coming into contact with the sheet discharge roller pair and a portion not coming into contact therewith, roller marks, i.e., image density nonuniformity, sometimes occur. The roller marks are, for example, coagulation nonuniformity occurring when the roller comes into contact with the toner image which is not fully cooled, and streaks occurring when a corner of the roller comes into contact with the sheet.

There are the following problems. When the sheet has low stiffness, the stiffening amount is insufficient. When the sheet has high stiffness, the sheet tends to strongly come into contact with the sheet discharge roller pair, and thus the roller marks are likely to occur. Therefore, it has been a challenge to achieve a balance between a configuration in which stiffening is strongly performed when a sheet with low stiffness such as a thin sheet of paper is fed, and a configuration in which occurrence of the roller marks is reduced through weakly performing stiffening when a sheet with high stiffness such as a thick sheet of paper is fed.

There is proposed a technology of changing a stiffening amount of a sheet according to a kind of the sheet (see Japanese Patent Application Laid-Open No. H03-88672). In the technology described in Japanese Patent Application Laid-Open No. H03-88672, there is provided a plurality of stiffening rollers movable in an axial direction of a sheet discharge roller, and positions of the stiffening rollers are shifted by a motor according to the kind of the sheet to be discharged. Thus, the technology of imparting desired stiffness to the sheet according to the kind of the sheet is proposed.

Further, there is proposed a technology of adjusting stiffening of a sheet with a configuration in which a roller shaft body is movable (see Japanese Patent Application Laid-Open No. 2001-302060). In the technology described in Japanese Patent Application Laid-Open No. 2001-302060, in an upper sheet discharge roller and a lower sheet discharge roller constituting a sheet discharge roller pair, a plurality of star wheels is provided to a side of the upper sheet discharge roller, and rollers with rib are provided to a side of the lower sheet discharge roller. There is obtained positional relation in which outer peripheral portions of the star wheels and outer peripheral portions of the rollers with rib overlap each other when viewed in an axial direction. In the technology, a rotating member with a cam surface (tapered surface) is provided. When a rotating shaft of the lower sheet discharge roller is pressed against the cam surface and the rotating member is rotated by a motor, the lower sheet discharge roller moves in the axial direction in conjunction with the cam surface. Thus, an axial distance between the star wheels of the upper sheet discharge roller and the rollers with rib of the lower sheet discharge roller is changed, a corrugating amount of the sheet is increased or decreased, and desired stiffening is performed on the sheet according to a kind of the sheet.

In the technologies disclosed in the above-mentioned patent publications, the stiffening amount of the sheet is changed according to a material and size of the sheet with use of drive from the motor. However, according to each of the configurations, it costs to provide a mechanism for transmitting rotation of the motor, and a control circuit for controlling the motor. Further, the configuration is complicated, and hence there arises a problem in that large space is required and a size of the apparatus is increased.

SUMMARY OF THE INVENTION

Therefore, it is an object of the present invention to provide an image forming apparatus which has a low-cost and simple configuration, and performs proper stiffening on sheets irrespective of kinds of the sheets.

According to the present invention, there is provided an image forming apparatus including: an image forming unit configured to form an image on a sheet; a roller pair configured to discharge the sheet having the image formed thereon, the roller pair which has a first roller including a plurality of first roller bodies arranged at intervals in an axial direction and a second roller including a second roller body arranged between the plurality of first roller bodies in the axial direction; a support portion configured to support the first roller and the second roller so as to be able to increase/decrease a distance between an axis line of the first roller and an axis line of the second roller; an elastic member configured to urge at least one of the first roller and the second roller so as to relatively bring one of the first roller and the second roller close to another of the first roller and the second roller; and a regulating portion configured to regulate, at a position at which the plurality of first roller bodies and the second roller body overlap each other in a direction orthogonal to the axial direction, movement of the at least one of the first roller and the second roller in a direction of increasing the distance between the axis line of the first roller and the axis line of the second roller while the sheet is passing between the first roller and the second roller.

According to the present invention, in a case of the sheet such as a thin sheet of paper, in a state of keeping the distance between the axis line of the first roller and the axis line of the second roller without being affected by stiffness of the sheet, the first roller and the second roller discharge the sheet after performing proper stiffening on the sheet such as the thin sheet of paper. In a case of the sheet such as a thick sheet of paper, the first roller and the second roller function to increase the distance between the axis line of the first roller and the axis line of the second roller against the urging force of the elastic member. However, the regulating portion regulates shaft movement at the position at which the part of the plurality of first roller bodies and the part of the second roller body overlap each other when viewed in the axial direction, and hence reduction of a stiffening force with respect to the sheet is prevented. With such simple configuration, it is possible to discharge the sheet in a state in which proper stiffening is performed on the sheet according to a kind of the sheet.

Further features of the present invention will become apparent from the following description of exemplary embodiments with reference to the attached drawings.

DESCRIPTION OF THE EMBODIMENTS

Hereinafter, with reference to the drawings, an embodiment in which an electrophotographic color laser printer is applied as an example of an image forming apparatus according to the present invention is specifically described. Unless otherwise specified, scope of the present invention should not be construed restrictively in terms of dimensions, materials, and shapes of components, and relative arrangement thereof, which are described in this embodiment.

Figure 2:
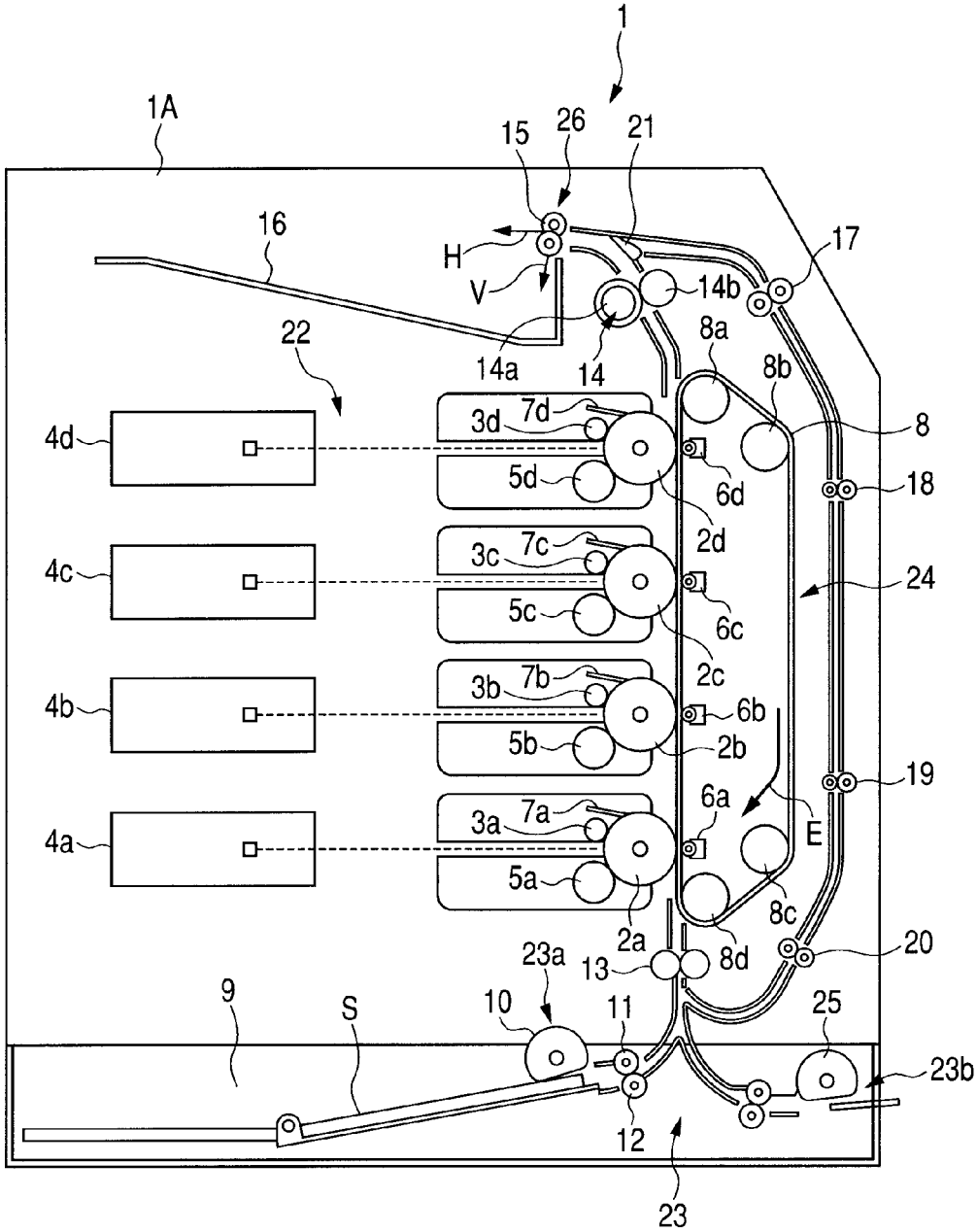
FIG. 2 is a schematic view illustrating an entire configuration of an electrophotographic printer as an example of an image forming apparatus according to a first embodiment of the present invention.

As illustrated in FIG. 2, a color laser printer main body 1A (hereinafter, referred to as printer main body) of a color laser printer 1 serving as the image forming apparatus includes an image forming unit 22 for forming an image on a sheet, a sheet feeding unit 23, a transfer unit 24, and a fixing device 14. The image forming unit 22 includes photosensitive drums 2 (2*a*, 2*b*, 2*c*, and 2*d*) serving as image bearing bodies which are arranged in an up-down direction and respectively bear toner images of four colors, i.e., yellow, magenta, cyan, and black colors. Around the photosensitive drums 2, charging devices 3 (3*a*, 3*b*, 3*c*, and 3*d*), scanner units 4 (4*a*, 4*b*, 4*c*, and 4*d*), developing devices 5 (5*a*, 5*b*, 5*c*, and 5*d*), and cleaning devices 7 (7*a*, 7*b*, 7*c*, and 7*d*) are arranged in a rotating direction.

The charging devices 3 (3*a* to 3*d*) uniformly charge surfaces of the photosensitive drums. The scanner units 4 (4*a* to 4*d*) form electrostatic latent images on the photosensitive drums 2 (2*a* to 2*d*) by irradiation of laser beam based on image information. The developing devices 5 (5*a* to 5*d*) cause toner to adhere onto the electrostatic latent images, to thereby visualize the electrostatic latent images as toner images. The cleaning devices 7 (7*a* to 7*d*) remove transfer residual toner remaining on the surfaces of the photosensitive drums 2 (2*a* to 2*d*) after the toner images are transferred.

In the color laser printer 1 including a sheet discharge unit 26 for discharging a sheet to the outside of the apparatus, the photosensitive drums 2 (2*a* to 2*d*), the charging devices 3 (3*a* to 3*d*), the developing devices 5 (5*a* to 5*d*), and the cleaning devices 7 (7*a* to 7*d*) are integrated into a cartridge unit. In the color laser printer 1, images of different colors (yellow, cyan, magenta, and black colors) are formed by an electrophotographic recording method. Transfer rollers 6 (6*a*, 6*b*, 6*c*, and 6*d*) are provided inside a transfer conveying belt 8 for conveying a sheet, and sandwich the transfer conveying belt 8 together with the photosensitive drums 2 (2*a* to 2*d*). The transfer conveying belt 8 circulates and moves as a sheet conveying unit so as to be held in contact with all the photosensitive drums 2 (2*a* to 2*d*) while being opposed thereto. The transfer conveying belt 8 is wound around four rollers, i.e., a drive roller 8*a*, driven rollers 8*b* and 8*c*, and a tension roller 8*d*. The drive roller 8*a* is rotationally driven by a drive motor (not shown), and thus rotated in an arrow E direction.

The transfer rollers 6 (6*a* to 6*d*) are connected to a transfer bias source (not shown), and a positive charge is applied from the transfer rollers 6 (6*a* to 6*d*) to the sheet through the transfer conveying belt 8. Through application of transfer bias, toner images of respective colors with negative polarity, which are formed on the photosensitive drums, are sequentially transferred onto the sheet which is held in contact with the photosensitive drums 2 (2*a* to 2*d*) while being held by the transfer conveying belt 8. Consequently, a multi-color image is formed.

The sheet feeding unit 23 includes a cassette feed device 23*a* for feeding, by a pickup roller (sheet feeding roller) 10, a sheet S contained in a sheet feeding cassette 9 provided in a lowermost portion of the apparatus. Further, the sheet feeding unit 23 includes a multi-feed device 23*b* for feeding, by a pickup roller 25, the sheet S contained (supported) in a multi-feed tray (not shown). The sheet feeding cassette 9 contains a plurality of sheets S, and is loaded into a bottom of the printer main body. The multi-feed tray is opened during use, and supports a plurality of sheets S.

At the time of image formation, for example, the sheets S contained in the sheet feeding cassette 9 are separated and fed one by one by the pickup roller 10. Then, the separated and fed sheet S is conveyed at predetermined timing to the transfer unit 24 by a registration roller pair 13 for correcting skew feed of the sheet S. When the sheets S are fed from the multi-feed tray (not shown), the sheets S contained in the multi-feed tray are separated and fed one by one by the pickup roller 25. Then, the separated and fed sheet S is conveyed to the transfer unit 24 by the registration roller pair 13.

The transfer unit 24 includes the transfer conveying belt 8 provided to be opposed to the photosensitive drums 2 (2*a* to 2*d*). The transfer conveying belt 8 electrostatically absorbs the sheet on its outer peripheral surface opposed to the photosensitive drums 2 (2*a* to 2*d*), and circulates and moves so as to bring the sheet into contact with the photosensitive drums 2 (2*a* to 2*d*). By being electrostatically absorbed by the circulating and moving transfer conveying belt 8, the sheet S is conveyed to a transfer position by the transfer conveying belt 8, and the toner images formed on the photosensitive drums 2 (2*a* to 2*d*) are transferred onto the sheet. As a unit for feeding/conveying the sheets S, provided are the sheet feeding cassette 9, the registration roller pair 13, the fixing device 14 for fixing the toner images, and a sheet discharge roller pair 15 for discharging the sheets S to a sheet discharge tray 16 serving as a sheet stacking unit.

In order to form the toner images on a second side of the sheet S, a duplex flapper 21 is operated so as to guide the sheet S to be switched back to a side of a refeeding roller pair 17. When the sheet S is not conveyed, the duplex flapper 21 waits at a position of guiding the sheet S to the side of the refeeding roller pair 17. When the sheet S is conveyed from the fixing device 14, the sheet S lifts up the duplex flapper 21, and is thus conveyed to a side of the sheet discharge roller pair 15. In order to form the toner images on the second side of the sheet S, each of duplex conveying roller pairs 17, 18, 19 and 20 conveys the sheet S to the image forming unit 22.

An operation of the color laser printer 1 at the time of image formation is described. First, when the laser beam irradiated from the scanner units 4 (4*a* to 4*d*) correspondingly to the image information is scanned onto the surfaces of the photosensitive drums 2 (2*a* to 2*d*) uniformly charged by the charging devices 3 (3*a* to 3*d*), latent images are formed on the surfaces of the photosensitive drums. The latent images are developed by the developing devices 5 (5*a* to 5*d*), and thus the toner images of four colors, i.e., yellow, magenta, cyan, and black colors, are formed on the surfaces of the photosensitive drums 2 (2*a* to 2*d*).

Concurrently with the toner image forming operation, the sheets S contained in the sheet feeding cassette 9 are picked up by the pickup roller 10. Further, the sheets S contained in the multi-feed tray (not shown) are separated and conveyed one by one by the pickup roller 25. Thereafter, the sheet S fed from the sheet feeding cassette 9 or the multi-feed tray is guided to the registration roller pair 13. Then, the sheet S is conveyed to the transfer unit 24 by the registration roller pair 13 in synchronization with the image forming operation. The sheet S conveyed to the transfer unit 24 is absorbed onto the transfer conveying belt 8, and is conveyed to transfer portions in which the photosensitive drums 2 (2*a* to 2*d*) and the transfer conveying belt 8 are held in press-contact with each other.

Due to actions of the transfer rollers 6 (6*a* to 6*d*) which are respectively arranged in the transfer portions and applied with a voltage with polarity opposite to the polarity of the toner, onto the sheet S conveyed to the transfer portions, the toner images of respective colors formed on the photosensitive drums 2 (2*a* to 2*d*) are sequentially superimposed and transferred onto the sheet. The sheet S on which the toner images of four colors are multiple-transferred is separated from the transfer conveying belt 8, and is conveyed to the fixing device 14.

After the fixing toner images are transferred, the sheet S conveyed to the fixing device 14 is pressurized and heated in the fixing device 14. That is, the fixing device 14 includes a fixing sleeve 14*a* serving as a heat source, and a pressure roller 14*b* for applying pressure to the sheet S while being held in press-contact with the fixing sleeve 14*a*. The sheet S passing the fixing device 14 is conveyed and applied with heat and pressure by the fixing device 14. As a result, a full-color print image is fixed as a permanent image on the sheet. After the full-color print image is fixed as the permanent image, the sheet S is discharged by the sheet discharge roller pair 15, and is stacked onto the sheet discharge tray 16 provided below the sheet discharge roller pair 15.

At the time of double-sided printing, the sheet S, which has the image fixed in the fixing device 14 on its first side, passes the duplex flapper 21, is conveyed to the sheet discharge roller pair 15 of the sheet discharge unit 26, and is conveyed to a side of the sheet discharge tray 16 by the sheet discharge roller pair 15. Then, the sheet discharge roller pair 15 is reversely operated in response to a signal output from a control unit (not shown) before a tail end of the sheet S passes through the sheet discharge roller pair 15. Therefore, while the tail end is in the lead, the sheet S passes the duplex flapper 21, and is conveyed by the duplex conveying roller pairs 17, 18, 19, and 20. The sheet S enters a conveyance path extending from a feed roller 11, and passes the registration roller pair 13 and the image forming unit of respective colors. As a result, image formation is performed on the second side of the sheet. Thereafter, the image is fixed on the second side of the sheet S in the fixing device 14, and is discharged by the sheet discharge roller pair 15 onto the sheet discharge tray 16. Thus, the double-sided printing is completed.

Figure 1:
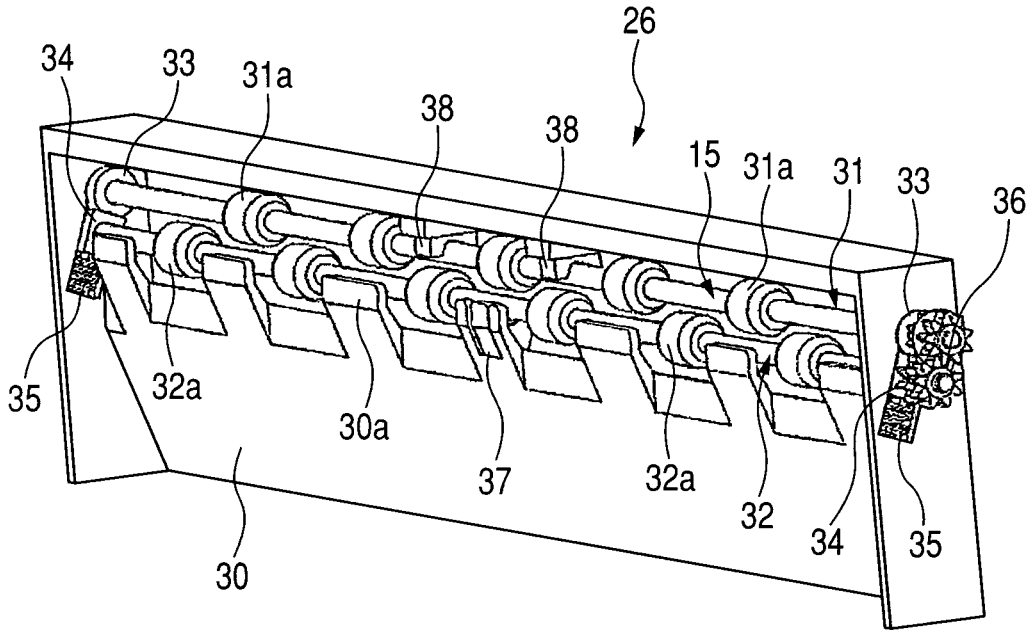
FIG. 1 is a perspective view illustrating a configuration of a sheet discharge unit of an image forming apparatus according to an embodiment of the present invention.

With reference to FIG. 1, there is described a detailed configuration of the sheet discharge unit 26 provided to the color laser printer 1, for discharging the sheet having the image formed thereon to the outside of the apparatus. In the sheet discharge unit 26, the sheet discharge roller pair 15 including an upper sheet discharge roller 31 and a lower sheet discharge roller 32 is arranged. The upper sheet discharge roller 31 as a first roller includes a plurality of (five, for example) roller bodies 31*a* arranged at predetermined intervals in its axial direction. The lower sheet discharge roller 32 as a second roller includes a plurality of (six, for example) roller bodies 32*a* arranged at predetermined intervals in its axial direction. The upper sheet discharge roller 31 and the lower sheet discharge roller 32 are supported by a sheet discharge frame 30 so as to be opposed and parallel to each other. The upper sheet discharge roller 31 and the lower sheet discharge roller 32 are supported so as to be able to increase/decrease a center distance between the axis line of the upper sheet discharge roller 31 and the axis line of the lower sheet discharge roller 32. At least part (all six roller bodies, in this embodiment) of the plurality of roller bodies 32*a* of the lower sheet discharge roller 32 are arranged so as not to be opposed to the roller bodies 31*a* of the upper sheet discharge roller 31 in the axial direction. When viewed in the axial direction, both the rollers 31 and 32 are arranged so that both the roller bodies 31*a* and 32*a* overlap each other in a radial direction of each of roller shafts 31*b* and 32*b*, and the rollers 31 and 32 constitute the sheet discharge roller pair 15 for discharging the sheet to the outside of the color laser printer 1. "Overlap" means a state in which the roller bodies 31*a* and the roller bodies 32*a* are brought close to each other in the radial direction of the shafts when the upper sheet discharge roller 31 and the lower sheet discharge roller 32 are viewed in the axial direction. In addition, for example, it can be formed that the second roller 32 has one roller body arranged between two first roller bodies 31*a* in the axial direction.

The upper sheet discharge roller 31 is supported by the sheet discharge frame 30 through upper roller bearings 33. The lower sheet discharge roller 32 is supported by the sheet discharge frame 30 through lower roller bearings 34 so as to be movable in a direction (up-down direction in FIG. 1) perpendicular to a sheet conveying direction (right-left direction in FIG. 1). One end of a pressure spring 35 is attached to the sheet discharge frame 30, and the other end thereof is attached to each of the lower roller bearings 34. In this state, each of the lower roller bearings 34 is pressed toward the upper sheet discharge roller 31 in the direction perpendicular to the sheet conveying direction, and an upper surface of each of the lower roller bearings 34 abuts against each of the upper roller bearings 33. Thus, each of the lower roller bearings 34 is positioned. The same configuration for urging with the pressure spring (elastic member) 35 is adopted to each end of the sheet discharge roller pair 15. With this configuration, the upper sheet discharge roller 31 and the lower sheet discharge roller 32 are urged in a direction in which they are brought close to each other, and thus positional relation between the upper sheet discharge roller 31 and the lower sheet discharge roller 32 is determined. The right and left upper roller bearings 33 and the lower roller bearings 34 constitute support units for supporting the upper sheet discharge roller 31 and the lower sheet discharge roller 32 so as to be able to increase/decrease the center distance between the upper sheet discharge roller 31 and the lower sheet discharge roller 32.

In this embodiment, the pressure spring 35 serving as a compression spring urges the lower roller bearing 34 with a force of 200 gf (≈2 N) applied to each side thereof. As long as the lower sheet discharge roller 32 is urged to the upper sheet discharge roller 31 (or the upper sheet discharge roller 31 is urged to the lower sheet discharge roller 32), as a matter of course, a coil spring, a plate spring, or a spring other than those springs can be used as the pressure spring 35. In this embodiment, all of the roller bodies 31*a* and 32*a* overlap each other. However, the present invention is not limited thereto. At least part of the roller bodies 31*a* and 32*a*, for example, the roller bodies 31*a* and 32*a* close to the center in the axial direction at which roller position regulating members 37 and 38 are located, may overlap each other. In this case, the substantially same effect can be also obtained.

In this embodiment, the lower-roller-position regulating member 37 is provided as a movement regulating portion for regulating the lower sheet discharge roller 32 at a predetermined position when the sheet discharge roller pair 15 moves against the pressure springs 35 in a direction of increasing the center distance. The upper-roller-position regulating members 38 are provided between the roller bodies 31*a* of the upper sheet discharge roller serving as the first roller, and the lower-roller-position regulating member 37 is provided between the roller bodies 32*a* of the lower sheet discharge roller 32 serving as the second roller. That is, the upper-roller-position regulating members 38 are arranged between the roller bodies 31*a* at the center portion in a longitudinal direction of the upper sheet discharge roller shaft 31*b* of the upper sheet discharge roller 31 (see FIG. 1). The lower-roller-position regulating member 37 is arranged between the roller bodies 32*a* at the center portion in the longitudinal direction of the lower sheet discharge roller shaft 32*b* of the lower sheet discharge roller 32 (see FIG. 1).

In this embodiment, the lower-roller-position regulating member 37 is a movement regulating portion of the present invention for regulating movement of the lower sheet discharge roller 32 at a predetermined position when the lower sheet discharge roller 32 moves against an urging force of the pressure springs 35 to increase the center distance between the upper sheet discharge roller 31 and the lower sheet discharge roller 32. The upper sheet discharge roller 31 may move against the urging force of the pressure springs 35 to increase the center distance between the upper sheet discharge roller 31 and the lower sheet discharge roller 32, and a clearance c set to a side of the lower-roller-position regulating member 37 may be provided to a side of the upper-roller-position regulating members 38. In this case, the upper-roller-position regulating members 38 can be used as the movement regulating portion of the present invention. The upper sheet discharge roller 31 is rotationally driven by a drive source (not shown), and its rotation is transmitted to the lower sheet discharge roller 32 through a lower-sheet-discharge-roller drive gear group 36. At a position opposed to the center portion of the lower sheet discharge roller 32 in the sheet discharge frame 30, the lower-roller-position regulating member 37 is provided.

The lower-roller-position regulating member 37 includes a lower-roller-shaft abutting surface 37*a* (see FIGS. 6A and 6B) serving as a regulating portion with which the lower sheet discharge roller shaft 32*b* moving in a direction (arrow V direction in FIGS. 2 and 7) perpendicular to the sheet conveying direction (arrow H direction in FIGS. 2 and 7) is brought into contact. In addition, the lower-roller-position regulating member 37 includes a lower-roller-shaft abutting portion 37*b* (second regulating portion) serving as an abutting portion with which the lower sheet discharge roller shaft 32*b* moving upstream in the sheet conveying direction (arrow F direction in FIG. 7) is brought into contact. That is, the certain clearance c is set so that the lower sheet discharge roller shaft 32*b* is brought into contact with the lower-roller-shaft abutting surface 37*a* in a case where the lower sheet discharge roller 32 is separated by a certain distance or more from the upper sheet discharge roller 31 when the lower sheet discharge roller 32 moves against the pressure springs 35 to be separated from the upper sheet discharge roller 31. The lower-roller-position regulating member 37 is set so that a moving amount (i.e., clearance c), by which the lower sheet discharge roller 32 moves in a direction of increasing the center distance between the upper sheet discharge roller 31 and the lower sheet discharge roller 32, does not exceed an overlapping amount d (see FIG. 6A), by which the roller bodies 31*a* and the roller bodies 32*a* overlap each other in the radial direction. That is, the lower-roller-shaft abutting surface 37*a* of the lower-roller-position regulating member 37 regulates movement of the lower sheet discharge roller 32 at a position at which the roller bodies 31*a* and the roller bodies 32*a* overlap each other when viewed in the axial direction. In the lower-roller-position regulating member 37, a certain clearance is formed between the lower-roller-shaft abutting portion 37*b* and the lower sheet discharge roller shaft 32*b* which is not subjected to deflection. In the lower-roller-position regulating member 37, the lower-roller-shaft abutting portion 37*b* regulates the movement of the lower sheet discharge roller 32 so as to prevent deflection of the lower sheet discharge roller 32 when a tensile force applied upstream in the sheet conveying direction (arrow F direction in FIG. 9B) acts on the lower sheet discharge roller 32.

Near an upper center portion of the sheet discharge frame 30, the two upper-roller-position regulating members 38 are arranged so as to be located on both sides of the lower-roller-position regulating member 37 located below the upper-roller-position regulating members 38. In the two upper-roller-position regulating members 38, upper-roller-shaft abutting portions 38*a* described below are brought into contact with the upper sheet discharge roller shaft 31*b* in advance, and a clearance like the clearance c provided to the lower-roller-position regulating member 37 is not formed. In the upper-roller-position regulating members 38, a certain clearance is formed between each of upper-roller abutting surfaces 38*b* to be described below as abutting portions and the upper sheet discharge roller shaft 31*b* which is not subjected to deflection. The upper-roller-position regulating members 38 have a function (see FIG. 8B) for regulating deflection of the upper sheet discharge roller 31 when the upper sheet discharge roller shaft 31*b* of the upper sheet discharge roller 31 is deflected upstream in the sheet conveying direction (arrow F direction).

The upper-roller-position regulating members 38 have a function (see FIG. 8A) for regulating the deflection of the upper sheet discharge roller 31 when the upper sheet discharge roller shaft 31*b* of the upper sheet discharge roller 31 is deflected in the direction (upward arrow V direction) perpendicular to the sheet conveying direction when the sheet S passes the sheet discharge roller pair 15. A surface 30*a* of the sheet discharge frame 30 constitutes a sheet jamming prevention surface, and prevents the sheet S discharged from the sheet discharge roller pair 15 to the sheet discharge tray 16 to be stacked on the sheet discharge tray 16 from jamming between the lower sheet discharge roller 32 and the sheet discharge frame 30.

Figure 3A:
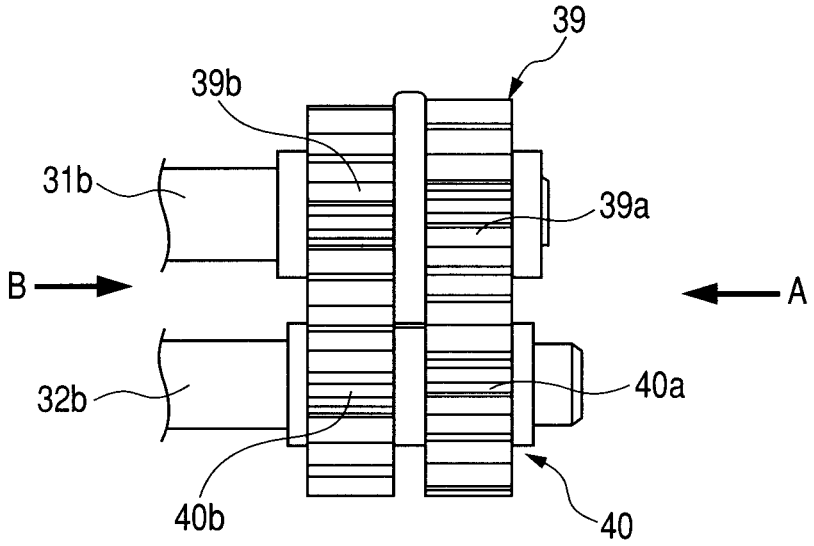
FIGS. 3A, 3B, and 3C are views illustrating a detailed configuration of a lower-sheet-discharge-roller drive gear group as a unit for transmitting drive from an upper sheet discharge roller to a lower sheet discharge roller in the image forming apparatus.
Figure 3B:
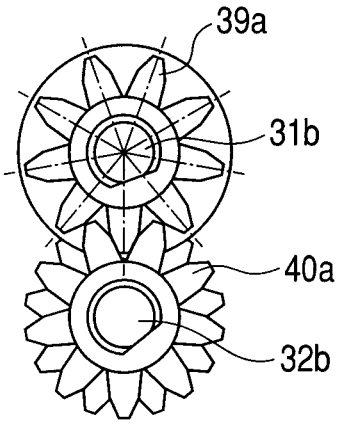
Figure 3C:
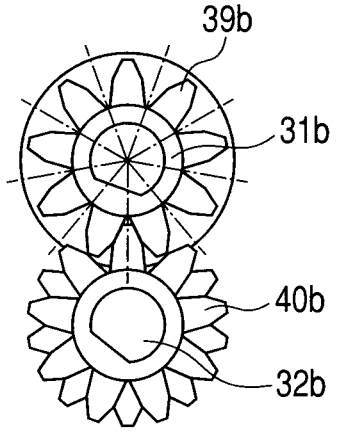

With reference to FIGS. 3A, 3B, and 3C, a drive transmission unit for transmitting a drive force to the sheet discharge roller pair 15 is described. FIGS. 3A, 3B, and 3C illustrate in detail the lower-sheet-discharge-roller drive gear group 36 for transmitting drive to the lower sheet discharge roller 32. FIG. 3A is a front view of the lower-sheet-discharge-roller drive gear group 36, FIG. 3B is a side view thereof when viewed in the A direction of FIG. 3A, and FIG. 3C is a side view thereof when viewed in the B direction of FIG. 3A.

As illustrated in FIG. 3A, a main drive gear 39 is provided to an end portion of the upper sheet discharge roller shaft 31*b*, and a driven gear 40 is provided to an end portion of the lower sheet discharge roller shaft 32*b*. The main drive gear 39 includes a first gear portion 39*a* and a second gear portion 39*b* on the same axis, and the driven gear 40 includes a first gear portion 40*a* and a second gear portion 40*b* on the same axis. The main drive gear 39 performs drive transmission on the first gear portion 40*a* and the second gear portion 40*b* provided on the lower sheet discharge roller shaft 32*b*. Chain double-dashed lines illustrated in FIG. 3B connect tooth tips of the first gear portion 39*a* of the main drive gear 39 to a gear center thereof. Chain double-dashed lines illustrated in FIG. 3C also connect the tooth tips of the first gear portion 39*a* to the gear center thereof. As illustrated in FIG. 3C, the first gear portion 39*a* and the second gear portion 39*b* are relatively shifted in phase by a 0.5 tooth pitch. At each shaft end portion of the upper sheet discharge roller 31 and each shaft end portion of the lower sheet discharge roller 32, the first gear portion 39*a* is meshed with the first gear portion 40*a*, and the second gear portion 39*b* is meshed with the second gear portion 40*b*. Thus, the minimum center distance between the rollers 31 and 32 is secured.

The first gear portion 39*a* and the second gear portion 39*b* of the main drive gear 39 are identical in pitch diameter, module, and shifting amount. In order to correspond to phase shift of the main drive gear 39, the first gear portion 40*a* and the second gear portion 40*b* of the driven gear 40 are also relatively shifted in phase by a 0.5 tooth pitch. This configuration is made to be able to transmit the drive to the lower sheet discharge roller 32 while increasing meshing of gears and securing a retreating amount when the lower sheet discharge roller 32 moves so as to be separated from the upper sheet discharge roller 31.

Figure 4:
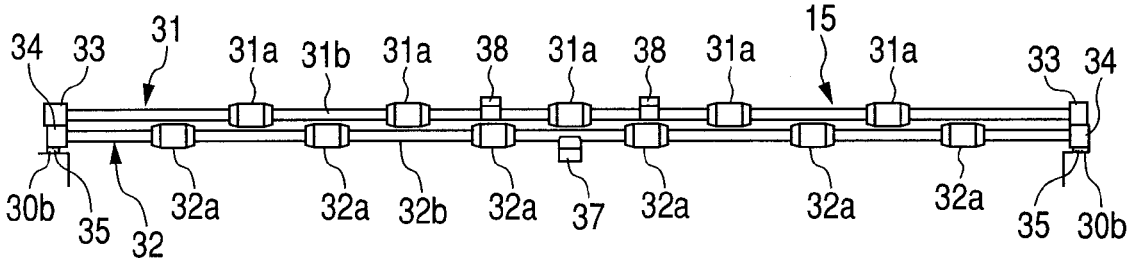
FIG. 4 is a front view illustrating a configuration of a sheet discharge roller pair of the image forming apparatus.

With reference to FIG. 4, a detailed configuration of the sheet discharge roller pair 15 is described. As illustrated in FIG. 4, the plurality of roller bodies 31*a* made of foamed silicone rubber is attached to the upper sheet discharge roller 31 at equal intervals, and the plurality of roller bodies 32*a* made of foamed silicone rubber is attached to the lower sheet discharge roller 32 at equal intervals. End portions of each of the roller bodies 31*a* and end portions of each of the roller bodies 32*a* are tapered. The roller bodies 31*a* of the upper sheet discharge roller 31 and the roller bodies 32*a* of the lower sheet discharge roller 32 are different from each other in terms of axial positions, and a configuration is made to prevent nipping caused by contact between the upper sheet discharge roller 31 and the lower sheet discharge roller 32. As illustrated on right and left sides of FIG. 4, the sheet discharge frame 30 (see FIG. 1) is provided with lower-roller-bearing abutting surfaces 30*b*. The right and left lower-roller-bearing abutting surfaces 30*b* abut against the lower roller bearings 34 when the lower sheet discharge roller 32 retreats (moves) away from the upper sheet discharge roller 31 against the pressure springs 35 by a certain amount.

Figure 5A:
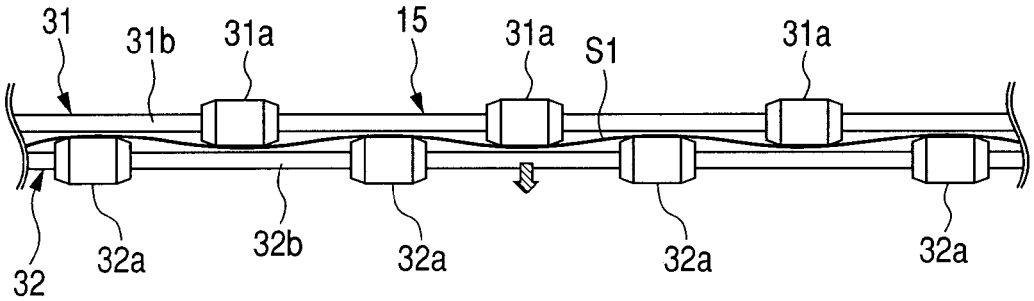
FIGS. 5A and 5B are views illustrating behaviors of a sheet when a thin sheet of paper is conveyed to the sheet discharge roller pair in the image forming apparatus and when a thick sheet of paper is conveyed thereto.
Figure 5B:
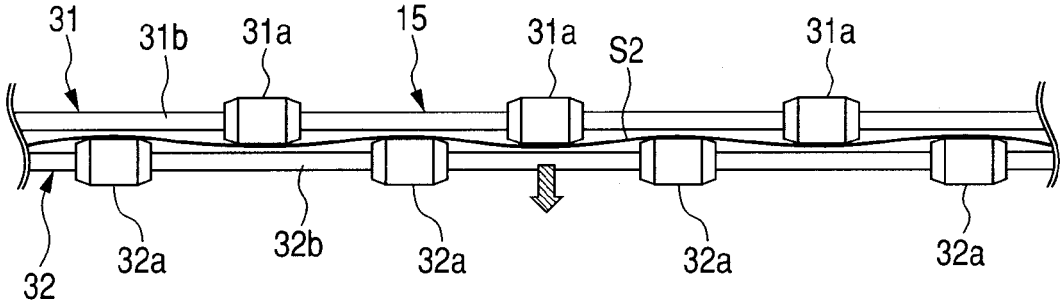

With reference to FIGS. 5A and 5B, there is described a configuration of stiffening a sheet when conveying the sheet, such a thin sheet of paper with low stiffness, or the sheet, such a thick sheet of paper with high stiffness, by the sheet discharge roller pair 15. There is also described positional relation in the center distance direction between the lower-roller-position regulating member 37 and the lower sheet discharge roller 32 when the lower sheet discharge roller 32 retreats away from the upper sheet discharge roller 31. FIG. 5A illustrates a state in which a sheet (thin sheet of paper S1) such as a thin sheet of paper conveyed to the sheet discharge roller pair 15 is stiffened. FIG. 5B illustrates a state in which a sheet (thick sheet of paper S2) such as a thick sheet of paper conveyed to the sheet discharge roller pair 15 is stiffened.

As illustrated in FIG. 4, the roller bodies 31*a* and the roller bodies 32*a* keep relation in which the roller bodies 31*a* and the roller bodies 32*a* partially overlap each other as if they enter into each other when viewed in the axial direction (that is, when the upper sheet discharge roller 31 and the lower sheet discharge roller 32 are viewed from the right or left side of FIG. 4). With this configuration, stiffening is performed by corrugating the sheet S in a width direction thereof, and the sheet S is smoothly discharged to the sheet discharge tray 16.

As illustrated in FIG. 5A, in a case where the thin sheet of paper S1 is conveyed by the sheet discharge roller pair 15, the thin sheet of paper S1 has a small thickness and low stiffness, and hence an amount by which the lower sheet discharge roller 32 retreats away from the upper sheet discharge roller 31 due to resistance of the thin sheet of paper S1 is small. Therefore, the overlapping amount between the upper sheet discharge roller 31 and the lower sheet discharge roller 32 is increased, and it is possible to stiffen the thin sheet of paper S1 strongly. Meanwhile, as illustrated in FIG. 5B, in a case where the thick sheet of paper S2 is conveyed by the sheet discharge roller pair 15, the thick sheet of paper S2 has a large thickness and high stiffness, and hence an amount by which the lower sheet discharge roller 32 retreats away from the upper sheet discharge roller 31 due to resistance of the thick sheet of paper S2 is large. Therefore, the overlapping amount between the upper sheet discharge roller 31 and the lower sheet discharge roller 32 is decreased, and it is possible to stiffen the thick sheet of paper S2 weakly when compared to the case of the thin sheet of paper S1.

In order to achieve reduction in size of the apparatus and reduction in cost, and to secure the overlapping amount d when the upper sheet discharge roller 31 and the lower sheet discharge roller 32 are viewed in the axial direction, a relatively thin shaft is used for each of the upper sheet discharge roller 31 and the lower sheet discharge roller 32. For example, in a case where a shaft with a diameter of 4 mm is adopted as each of the upper sheet discharge roller 31 and the lower sheet discharge roller 32, deflection is generated due to an external force, and roller positions are not stabilized. As a result, a stiffening force of the sheet discharge roller pair 15 with respect to the sheet may be reduced more than required. Thus, design needs to be made in consideration therewith.

Figure 6A:
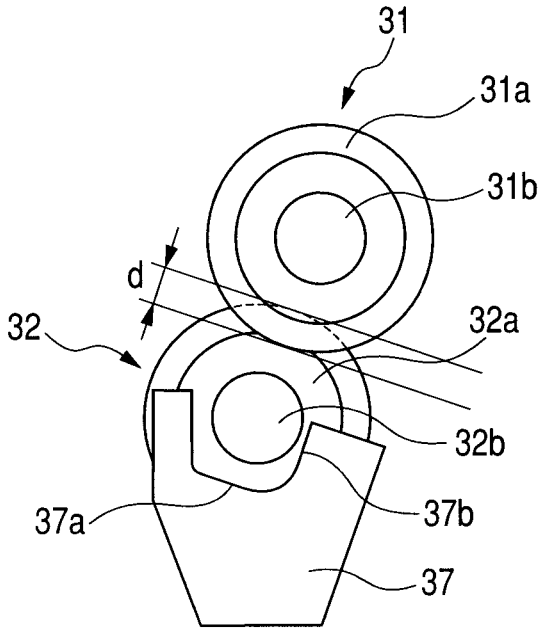
FIGS. 6A and 6B are views illustrating relation between a lower-roller-position regulating member and the lower sheet discharge roller when the thin sheet of paper is conveyed in the image forming apparatus and when the thick sheet of paper is conveyed therein.
Figure 6B:
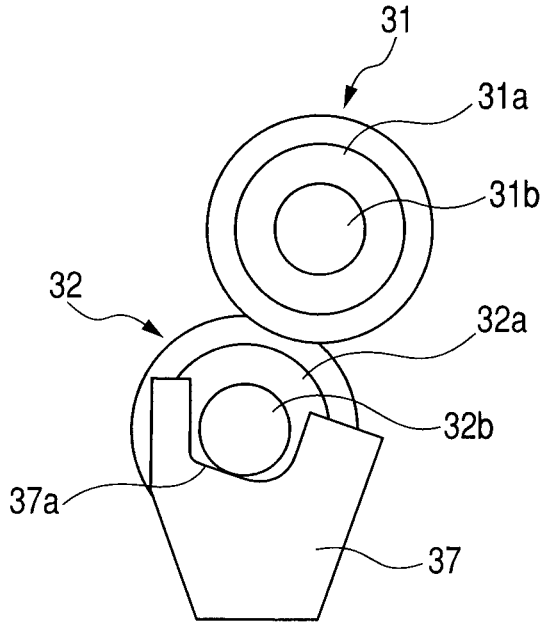

FIGS. 6A and 6B illustrate positional relation between the lower-roller-position regulating member 37 and the sheet discharge roller pair 15. FIG. 6A is a side view illustrating a state in which the lower sheet discharge roller 32 retreats away from the upper sheet discharge roller 31 when the sheet such as a thin sheet of paper with low stiffness is fed. FIG. 6B is a side view illustrating a state in which the lower sheet discharge roller 32 retreats away from the upper sheet discharge roller 31 when the sheet such as a thick sheet of paper with high stiffness is fed.

As illustrated in FIGS. 1 and 4, the lower-roller-position regulating member 37 is provided to the sheet discharge frame 30 (see FIG. 1) so as to regulate movement of a shaft portion of the center portion of the lower sheet discharge roller 32 in which a deflection amount of the lower sheet discharge roller 32 becomes largest. When the sheet such as a thin sheet of paper with low stiffness is conveyed to the sheet discharge roller pair 15, the resistance of the sheet is relatively small, and hence there is obtained positional relation in which the clearance exists between the lower sheet discharge roller shaft 32*b* of the lower sheet discharge roller 32 and the lower-roller-shaft abutting surface 37*a* (see FIG. 6A). Meanwhile, when the sheet such as a thick sheet of paper with high stiffness is conveyed to the sheet discharge roller pair 15, the resistance of the sheet is relatively large, and hence the lower sheet discharge roller 32 moves against the urging force of the pressure springs 35 to retreat away from the upper sheet discharge roller 31. Thus, the lower sheet discharge roller shaft 32*b* is brought into contact with the lower-roller-shaft abutting surface 37*a* of the lower-roller-position regulating member 37 (see FIG. 6B). In this case, while the deflection is generated in the lower sheet discharge roller 32, the lower sheet discharge roller shaft 32*b* abuts against the lower-roller-shaft abutting surface 37*a*, and hence the deflection and the retreating amount are regulated.

The clearance c between the lower-roller-shaft abutting surface 37*a* of the lower-roller-position regulating member 37 and the lower sheet discharge roller shaft 32*b* is set to be smaller than the overlapping amount d between the upper sheet discharge roller 31 and the lower sheet discharge roller 32. Thus, even when the lower sheet discharge roller shaft 32*b* abuts against the lower-roller-shaft abutting surface 37*a*, the overlapping amount d is secured, and hence it is possible to stiffen the sheet such as the thick sheet of paper with high stiffness to a certain degree. Further, it is possible to secure a conveying force with which the sheet discharge roller pair 15 conveys the sheet. Accordingly, the sheet can be stably discharged by the sheet discharge roller pair 15.

Figure 7:
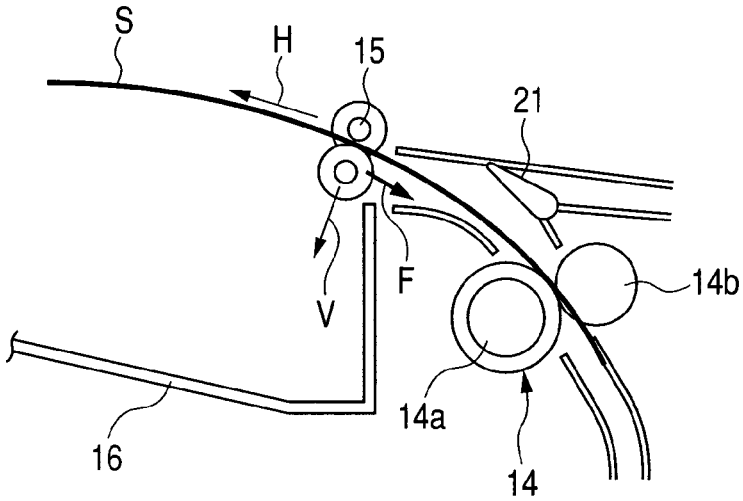
FIG. 7 is a view illustrating how the sheet behaves between a fixing device and the sheet discharge roller pair of the image forming apparatus and how load is applied to the sheet discharge roller pair.

With reference to FIGS. 7, 8A, 8B, 9A, and 9B, there is described a configuration for regulating positions of the upper sheet discharge roller 31 and the lower sheet discharge roller 32 against the deflection generated upstream in the sheet conveying direction. As illustrated in FIG. 7, in terms of speed relation in conveying the sheet S between the fixing device 14 and the sheet discharge roller pair 15, conveying speed of the sheet discharge roller pair 15 is generally set to be higher than conveying speed of the fixing device 14. Thus, the tensile force is generated in the sheet S located between the fixing device 14 and the sheet discharge roller pair 15, and the sheet discharge roller pair 15 receives a deflection force F applied toward the fixing device 14.

Figure 8A:
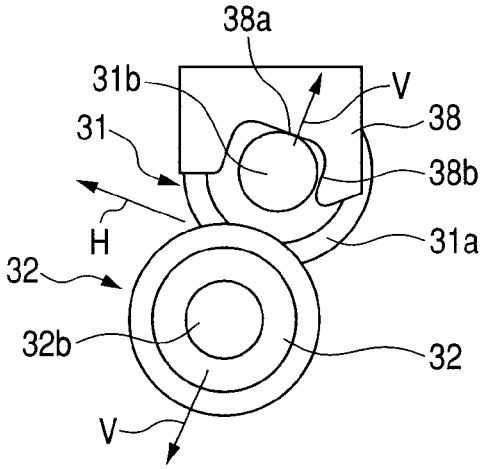
FIGS. 8A and 8B are views illustrating relation between an upper-roller-position regulating member and the upper sheet discharge roller when back tension acts on the sheet discharge roller pair of the image forming apparatus.
Figure 8B:
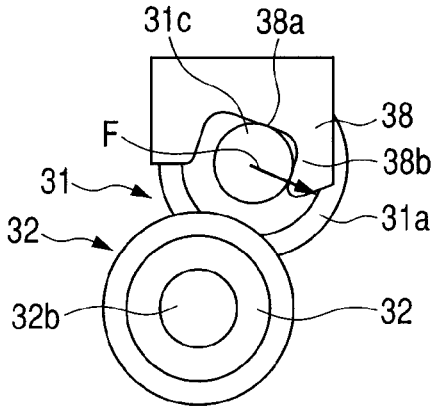

FIGS. 8A and 8B illustrate a configuration in which the deflection of the upper sheet discharge roller 31 generated upstream in the sheet conveying direction is regulated by the upper-roller-position regulating members 38. FIG. 8A illustrates positional relation between the upper sheet discharge roller 31 and the upper-roller-position regulating members 38 in a case where the deflection force F applied toward the fixing device 14 does not act on the sheet discharge roller pair 15. FIG. 8B illustrates the positional relation therebetween in a case where the deflection force F applied toward the fixing device 14 acts on the upper sheet discharge roller 31.

As illustrated in FIG. 8A, for the upper sheet discharge roller shaft 31*b* of the upper sheet discharge roller 31, the upper-roller-position regulating members 38 for regulating the deflection of the upper sheet discharge roller shaft 31*b* are provided to the sheet discharge frame 30 (see FIG. 1). The upper-roller-position regulating members 38 include the upper-roller-shaft abutting portions 38*a* for regulating the movement (deflection) of the upper sheet discharge roller shaft 31*b* in the direction (upward arrow V direction in FIG. 8A) perpendicular to the sheet conveying direction H. The upper-roller-position regulating members 38 include the upper-roller abutting surfaces (second regulating portions) 38*b* for regulating the movement (deflection) of the upper sheet discharge roller shaft 31*b* when the upper sheet discharge roller 31 receives a force applied toward upstream in the sheet conveying direction, that is, the force (indicated by the arrow F in FIG. 8B) applied toward the fixing device 14. Thus, the upper sheet discharge roller shaft 31*b* abuts against (is brought into contact with) the upper-roller-shaft abutting portions 38*a*, and is not deflected in the direction (upward arrow V direction) perpendicular to the sheet conveying direction H. In the sheet conveying direction H, a certain clearance is formed between the upper sheet discharge roller shaft 31*b* and each of the upper-roller abutting surfaces 38*b* of the upper-roller-position regulating members 38. When the upper sheet discharge roller 31 receives the deflection force F applied toward the fixing device 14, as illustrated in FIG. 8B, the upper sheet discharge roller shaft 31*b* is brought into contact with the upper-roller abutting surfaces 38*b* of the upper-roller-position regulating members 38, and thus the deflection of the shaft is regulated.

Figure 9A:
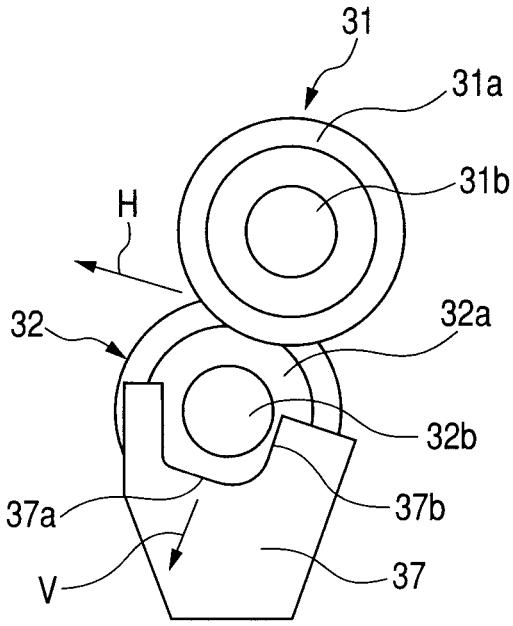
FIGS. 9A and 9B are views illustrating relation between the lower-roller-position regulating member and the lower sheet discharge roller when back tension acts on the sheet discharge roller pair of the image forming apparatus.
Figure 9B:
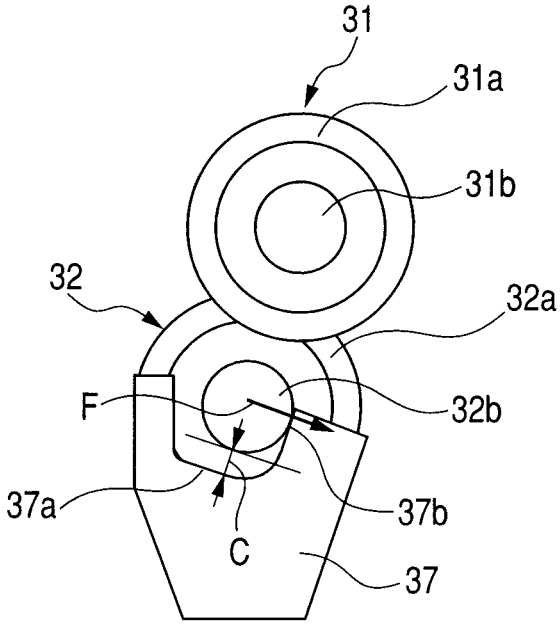

FIGS. 9A and 9B illustrate positional relation between the lower-roller-position regulating member 37 and the lower sheet discharge roller 32 when the force F acts on the lower sheet discharge roller 32. When the force F does not act, as illustrated in FIG. 9A, the clearance is formed between the lower sheet discharge roller shaft 32*b* and the lower-roller-position regulating member 37 on an upstream side in the sheet conveying direction (side opposite to the arrow H direction). When the force F acts on the lower sheet discharge roller 32, as illustrated in FIG. 9B, the lower sheet discharge roller shaft 32*b* is brought into contact with the lower-roller-shaft abutting portion (second regulating portion) 37*b*, and thus the deflection of the lower sheet discharge roller 32 is regulated.

In this embodiment, the lower sheet discharge roller 32 is structured to be able to retreat away from the upper sheet discharge roller 31, and the lower sheet discharge roller 32 is urged toward the upper sheet discharge roller 31 with the pressure springs 35. The lower-roller-position regulating member 37 and the upper-roller-position regulating members 38 are arranged, and hence, when the sheet such as the thin sheet of paper with low stiffness is conveyed, it is possible to keep the center distance between the upper sheet discharge roller 31 and the lower sheet discharge roller 32 without being affected by the stiffness of the sheet. Thus, an amount by which the lower sheet discharge roller 32 retreats away from the upper sheet discharge roller 31 is reduced, and the sheet can be discharged after being subjected to proper stiffening.

When the sheet such as the thick sheet of paper with high stiffness or glossy paper is conveyed, the lower sheet discharge roller 32 moves (retreats) away from the upper sheet discharge roller 31 against the urging force of the pressure springs 35, and the overlapping amount d between the upper sheet discharge roller 31 and the lower sheet discharge roller 32 is reduced. In this case, the movement of the shaft of the lower sheet discharge roller 32 is regulated by the lower-roller-position regulating member 37 in the middle of movement, and hence the stiffening force with respect to the sheet is prevented from being reduced more than required. Thus, contact between the sheet such as the thick sheet of paper with high stiffness and the sheet discharge roller pair 15 is appropriately weakened, and the stiffening force imparted to the sheet by the sheet discharge roller pair 15 is decreased. Therefore, proper stiffening can be performed irrespective of kinds of sheets, and the sheets can be stably stacked onto the sheet discharge tray 16. Further, reduction in occurrence of roller marks can be achieved at low cost and with a simple configuration.

As a material of the roller bodies 31*a* of the upper sheet discharge roller 31 and a material of the roller bodies 32*a* of the lower sheet discharge roller 32, foamed silicone rubber is used, and hence substantial contact area is smaller in comparison with solid rubber such as ethylene-propylene-diene-methylene (EPDM) rubber which is conventionally used. Both end portions of each of the roller bodies 31*a* of the upper sheet discharge roller 31 and both end portions of each of the roller bodies 32*a* of the lower sheet discharge roller shaft 32*b* are provided with tapered surfaces, and hence the both end portions are not strongly held in contact with the sheet S. With the roller configuration as described above, it is possible to reduce occurrence of the roller marks. The lower-roller-position regulating member 37 provided for the lower sheet discharge roller 32 and the upper-roller-position regulating members 38 provided for the upper sheet discharge roller 31 function to suppress the deflection generated in the center distance direction of the sheet discharge roller pair 15 and generated upstream in the sheet conveying direction. Thus, even when a diameter of the shaft is reduced, it is possible to regulate a change in roller position caused by the deflection, and to suppress the reduction of the stiffening force with respect to the sheet.

In this embodiment, the pressure springs 35 are provided to the side of the lower sheet discharge roller 32, and the lower sheet discharge roller 32 is movable in the direction perpendicular to the sheet conveying direction. However, it is also possible that the pressure springs 35 are provided to the side of the upper sheet discharge roller 31 and the upper sheet discharge roller 31 is movable in the direction perpendicular to the sheet conveying direction. In this case, the clearance c formed in the lower-roller-position regulating member 37 illustrated in FIGS. 9A and 9B is provided on the side of the upper-roller-position regulating members 38 illustrated in FIGS. 8A and 8B, and the upper-roller-position regulating members 38 serve as the movement regulating portions. It is also possible that the clearance c is formed in each of the lower-roller-position regulating member 37 and the upper-roller-position regulating member 38 and thus both of the upper sheet discharge roller shaft 31*b* and the lower sheet discharge roller shaft 32*b* are movable in the perpendicular direction. In this case, in order to set a moving amount in a direction of increasing the center distance between the upper sheet discharge roller 31 and the lower sheet discharge roller 32 so as not to exceed the overlapping amount d between the roller bodies 31*a* and the roller bodies 32*a*, the clearance c formed in each of the lower-roller-position regulating member 37 and the upper-roller-position regulating member 38 is set to have a half amount of the clearance illustrated in FIGS. 9A and 9B. In this case, both of the lower-roller-position regulating member 37 and the upper-roller-position regulating member 38 constitute the movement regulating portions of the present invention.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2009-111008, filed Apr. 30, 2009, which is hereby incorporated by reference herein its entirety.

What is claimed is:

1. An image forming apparatus, comprising:

an image forming unit configured to form an image on a sheet;

a roller pair configured to discharge the sheet having the image formed thereon, the roller pair having a first roller including a plurality of first roller bodies arranged at intervals in an axial direction and a second roller including a plurality of second roller bodies arranged between the plurality of first roller bodies in the axial direction, wherein the first roller and the second roller are arranged so that each of the second roller bodies is put into a space between two of the plurality of first roller bodies and an outer periphery of the plurality of the first roller bodies is out of contact with an outer periphery of the plurality of the second roller bodies;

a support portion configured to support the first roller and the second roller so as to be able to increase or decrease a distance between an axis line of the first roller and an axis line of the second roller;

an elastic member configured to urge the second roller so as to bring a shaft of the second roller close to a shaft of the first roller ;

a first regulating member arranged between the first roller bodies and configured to be brought into contact with the shaft of the first roller to regulate movement of the shaft of the first roller; and a second regulating member arranged between the second roller bodies so that clearance is set between the shaft of the second roller and the second regulating member and configured to regulate movement of the shaft of the second roller, wherein the second regulating member is configured to be capable of contacting with the shaft of the second roller to regulate, in a state that the second roller body is put into the space between the plurality of first roller bodies, movement of the second roller against the urging force of the elastic member in a direction of increasing the distance between the axis line of the first roller and the axis line of the second roller while the movement of the shaft of the first roller is regulated by the first regulating member.

2. An image forming apparatus according to claim 1, wherein the second regulating member is brought into contact with a center portion in an axial direction of a shaft of the second roller in order to regulate movement of the second roller.

3. An image forming apparatus according to claim 1, further comprising a fixing device configured to fix the image onto the sheet while nipping and conveying the sheet having the image formed thereon, wherein the fixing device and the roller pair simultaneously convey one sheet, and a sheet conveying speed of the roller pair is set to be higher than sheet conveying speed of the fixing device, the image forming apparatus further comprising a regulating portion configured to regulate upstream movement in a sheet conveying direction of the at least one of the first roller and the second roller.

4. An image forming apparatus according to claim 3, wherein the regulating portion is brought into contact with at least one of a center portion in an axial direction of a roller shaft of the first roller and a center portion in an axial direction of a roller shaft of the second roller, and regulates movement of one of the second roller body and the plurality of first roller bodies.

5. An image forming apparatus according to claim 1, further comprising a positioning portion configured to receive the urging force of the elastic member for positioning a position of the second roller with respect to the first roller.

6. An image forming apparatus according to claim 1, further comprising a stacking unit on which the sheet discharged by the roller pair is stacked;

a jamming prevention surface configured to prevent the sheet stacked on the stacking unit from jamming at the second roller; and a regulating portion configured to regulate upstream movement in a sheet conveying direction of the second roller, wherein the second regulating member is U-shaped and includes the jamming prevention surface and the regulating portion.

7. An image forming apparatus according to claim 1, further comprising a fixing device configured to fix the image onto the sheet while nipping and conveying the sheet having the image formed thereon, wherein the fixing device and the first and second roller simultaneously convey one sheet, and a sheet conveying speed of the first and second roller is set to be higher than sheet conveying speed of the fixing device, the image forming apparatus further comprising a regulating portion configured to regulate upstream movement in a sheet conveying direction of the at least one of the first shaft and the second shaft.

8. An image forming apparatus according to claim 7, wherein the regulating portion is brought into contact with at least one of a center portion in an axial direction of the first shaft and a center portion in an axial direction of the second roller shaft.

9. An image forming apparatus, comprising:

an image forming unit configured to form an image on a sheet;

a first roller configured to convey the sheet and including a first shaft, and a plurality of first roller bodies fixed on the first shaft and arranged at intervals in an axial direction;

a second roller configured to convey the sheet and including a second shaft, and a plurality of second roller bodies fixed on the second shaft and arranged between the plurality of first roller bodies in the axial direction, wherein the first roller and the second roller are arranged so that the second roller body is put into a space between the plurality of first roller bodies and an outer periphery of the plurality of the first roller bodies is out of contact with an outer periphery of the plurality of the second roller bodies;

a bearing portion configured to bear the second shaft;

a frame configured to movably support the bearing portion;

an elastic member provided between the flame and the bearing portion and configured to urge the second roller so as to bring the second shaft of the second roller close to the first shaft of the first roller;

a positioning portion configured to receive the urging force of the elastic member and to position the second shaft with respect to the first shaft in a direction closing to the first shaft;

a first regulating member arranged between the first roller bodies and configured to be brought into contact with the first shaft to regulate movement of the first shaft; and a second regulating member arranged between the second roller bodies so that clearance is set between the second shaft of the second roller and the second regulating member and configured to regulate movement of the second shaft of the second roller, wherein the second regulating member is configured to be capable of contacting with the second shaft to regulate, in a state that the second roller body is put into the space between the plurality of first roller bodies, movement of the second shaft in a direction of increasing the distance between the first shaft and the second shaft while the movement of the first shaft is regulated by the first regulating member.

10. An image forming apparatus according to claim 9, wherein the second regulating member is brought into contact with a center portion in an axial direction of the second shaft in order to regulate movement of the second roller.

11. An image forming apparatus, comprising:

an image forming unit configured to form an image on a sheet;

a roller pair configured to discharge the sheet having the image formed thereon, the roller pair having a first roller including a plurality of first roller bodies arranged at intervals in an axial direction and a second roller including a plurality of second roller bodies arranged between the plurality of first roller bodies in the axial direction, wherein the first roller and the second roller are arranged so that each of the second roller bodies is put into a space between two of the plurality of first roller bodies and an outer periphery of the plurality of the first roller bodies is out of contact with an outer periphery of the plurality of the second roller bodies;

a support portion configured to support the first roller and the second roller so as to be able to increase or decrease a distance between an axis line of the first roller and an axis line of the second roller;

an elastic member configured to urge the second roller so as to bring a shaft of the second roller close to a shaft of the first roller;

a first regulating member arranged between the first roller bodies and configured to be brought into contact with the shaft of the first roller to regulate movement of the shaft of the first roller;

a stacking unit on which the sheet discharged by the roller pair is stacked;

an U-shaped member arranged between the second roller bodies so that clearance is set between the shaft of the second roller and an inner portion of the U-shaped member and configured to regulate movement of the shaft of the second roller, wherein the inner portion of U-shaped member is configured to be capable of contacting with the shaft of the second roller to regulate, in a state that the second roller body is put into the space between the plurality of first roller bodies, movement of the second roller against the urging force of the elastic member in a direction of increasing the distance between the axis line of the first roller and the axis line of the second roller while the movement of the shaft of the first roller is regulated by the first regulating member, and the inner portion of U-shaped member being configured to regulate upstream movement in a sheet conveying direction of the shaft of second roller; and a jamming prevention surface disposed on an outer portion of the U-shaped member and configured to prevent the sheet stacked on the stacking unit from jamming at the second roller.

* * * * *